United States Patent [19]

Falk et al.

[11] 4,294,389

[45] Oct. 13, 1981

[54] DISPENSER FOR ROLLS OF PAPER

[76] Inventors: Filip Falk, Hammarbacken 22, S-182 35 Danderyd; Lennart Falk, Visborgsgatan 16, S-621 00 Visby, both of Sweden

[21] Appl. No.: 73,270

[22] Filed: Sep. 7, 1979

[30] Foreign Application Priority Data

Sep. 13, 1978 [SE] Sweden ..... 782101

[51] Int. Cl.[3] ..... B26D 1/02; B26F 3/02

[52] U.S. Cl. ..... 225/34; 225/41; 225/46; 242/55.3; 312/39

[58] Field of Search ..... 225/46, 77, 48–50, 225/53, 54, 34, 41; 83/649; 242/55.3; 312/39–42

[56] References Cited

U.S. PATENT DOCUMENTS

| | | | |
|---|---|---|---|
| 2,307,994 | 1/1943 | Clemens | 312/39 |
| 2,390,407 | 12/1945 | Willis | 225/46 |
| 2,592,346 | 4/1952 | Scogin | 312/39 X |
| 2,605,975 | 8/1952 | Page et al. | 312/39 X |
| 2,683,641 | 7/1954 | Larson | 225/46 |
| 2,871,078 | 1/1959 | Carleo | 312/39 |
| 2,872,264 | 2/1959 | Nehring | 242/55.3 X |
| 3,004,693 | 10/1961 | Johnson | 225/77 |
| 3,580,651 | 5/1971 | Gauper | 312/39 |

*Primary Examiner*—Frank T. Yost

*Attorney, Agent, or Firm*—Jack M. Wiseman; Francis W. Anderson

[57] ABSTRACT

A dispenser for a column of rolls of paper or the like. The rolls of paper are disposed in the dispenser one above the other. The dispensable roll of paper has the free end thereof disposed in the paper exit opening to be torn for removing the free end of the roll of paper from the remainder of the roll of paper. The dispenser includes a gate disposed between the dispensable roll of paper and the succeeding roll of paper thereabove for maintaining a spaced relation therebetween so that the dispensable roll of paper can be rotated without being in contact with the succeeding roll of paper. When the supply of paper of the dispensable roll of paper has been exhausted, the succeeding roll of paper is urged downwardly to displace the gate for advancing the succeeding roll of paper to the position of a dispensable roll of paper. The gate returns to its initial position to retain the roll of paper next in succession in spaced relation thereto. The free end of the roll of paper now occupying the position of the dispensable roll of paper projects through the exit opening for use by an operator.

5 Claims, 9 Drawing Figures

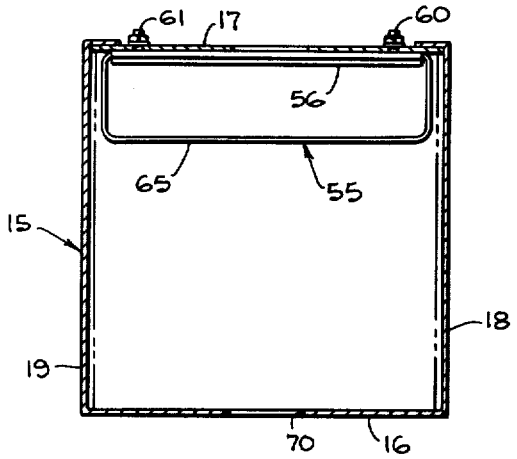
Fig 4
Fig 5
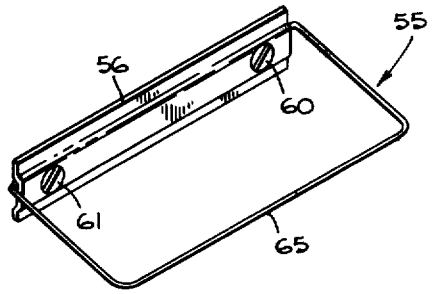
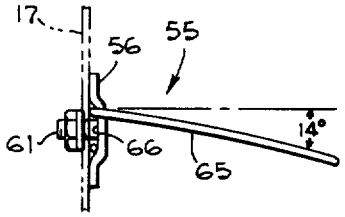
Fig 6
Fig 7
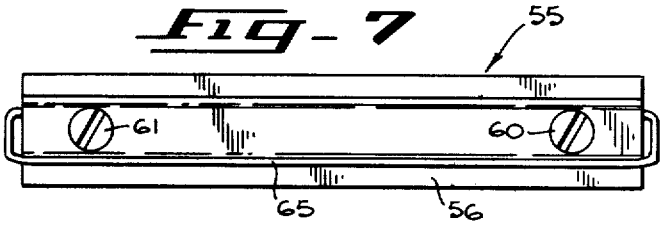
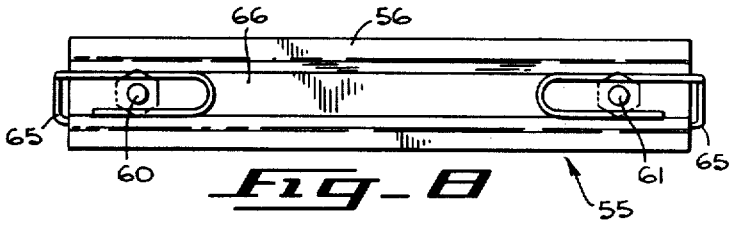
Fig 8
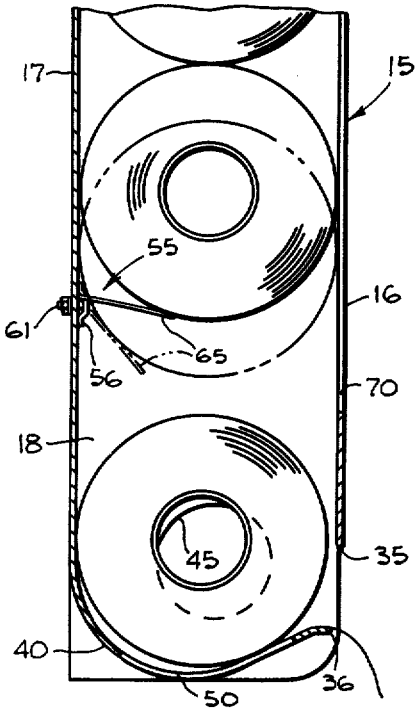
Fig 9

DISPENSER FOR ROLLS OF PAPER

BACKGROUND OF THE INVENTION

The present invention relates in general to dispensers, and more particularly to a dispenser for rolls of paper or the like.

It is desirable to store a plurality of rolls of paper, such as toilet tissues, paper towels and the like so that a successive roll of paper is immediately available upon the depletion of the supply of paper on the dispensable roll. In so doing, the arrangement should be such that the succeeding roll does not contact the dispensable roll to impede or interfere with the free rotation of the dispensable roll.

Dispensers have been known in which a plurality of rolls of paper were stored in a dispenser in a column. A flexible plate was fixedly secured to a side wall of the dispenser to support a roll of paper in spaced relation to the dispensable roll of paper. However, such a flexible plate was secured at a predetermined fixed height at all times. A vertical opening was provided in the front wall of the dispenser. A finger was insertable into the opening by an operator to move the stored roll into the position of the dispensable roll of paper. The flexible plate, however, was bent by the movement of the roll of paper toward the side wall to which it was secured. Additionally, the free end of the succeeding roll of paper was suspended adjacent the rear wall into the area occupied by the dispensable roll of paper. As a consequence thereof, the free end of the succeeding roll of paper interfered with the rotation of the dispensable roll of paper and interlockng therewith.

In the dispenser heretofore known for containing a plurality of rolls of paper disposed in a column, the exit opening was formed in the bottom of the dispenser and a cutting edge was disposed at the lower edge of the front wall. In order to sever the free end of the dispensable roll of paper, the free end of the dispensable roll of paper was raised upwardly by the operator to be severed by the cutting edge. This arrangement resulted in inconvenience to the operator because the fingers and the hand of the operator had a tendency to be in the vicinity of the cutting edge.

The dispenser heretofore known for containing a plurality of rolls of paper disposed in a column had aligned openings formed in the side walls for the removal of a core of an expended roll of paper. However, such openings are formed with the ticket exit opening. When the paper of the dispensable roll of paper has been extensively expended, operating problems have occurred during the cutting operation for the want of confinement by the housing of such a dispensable roll of paper.

SUMMARY OF THE INVENTION

A dispenser in which is disposed a column of rolls of paper or the like having the axes thereof disposed transversely in parallel relation. At the lower section of the dispenser is a paper exit opening through which the free end of the dispensable roll of paper projects to be torn from the remainder of the dispensable roll of paper. Disposed between the dispensable roll of paper and the succeeding roll of paper is an adjustably positioned gate to retain the succeeding roll of paper in spaced relation to the dispensable roll of paper. When the supply of paper of the dispensable roll of paper has been expended, the succeeding roll of paper is moved into the position of a dispensable roll of paper via the gate.

The gate of the dispenser of the present invention is vertically adjustable to accommodate for variations in diameter of the dispensable roll of paper so that the successive roll of paper is always disposed in spaced relation therewith. Additionally, the gate is adjustably supported by the rear wall of the housing and permitted to project toward the front wall so that the free end of the succeeding roll of paper is maintained spaced from the rear wall of the housing as well as from the front wall of the housing. The gate of the present invention positions the succeeding roll of paper toward the front wall of the housing, enabling the operator to engage the succeeding roll of paper with facility to advance it into the position of the dispensable roll of paper.

By virtue of the present invention, a plurality of rolls of paper may be stored in a column in a single dispenser without the succeeding roll of paper contacting the dispensable roll of paper to impede or interfere with the rotation of the dispensable roll of paper. When the supply of paper of the dispensable roll of paper has been exhausted, the succeeding roll of paper is prepared to occupy immediately the position of a dispensable roll of paper.

A feature of the present invention is the provision of openings in confronting side walls of the dispenser of the present invention separate and apart from the ticket exit opening for the removal of a core in the event the supply of paper on the dispensable roll of paper has beeen exhausted and the dispensable roll of paper employed a relatively rigid core, such as a cardboard core, at the axial center thereof.

Another feature of the present invention is to provide a dispenser for a column of rolls of paper with a paper exit opening for the free end of the dispensable roll of paper in which a bottom wall is disposed to support the dispensable roll of paper for rotation and formed in the bottom is an opening of sufficient width to permit the initial rotation of the dispensable roll of paper to place the free end thereof in position to be gripped by an operator with facility.

Still another feature of the present invention is the formation of a ticket exit opening between the side walls of the dispenser at the lower extremity of the front wall of the dispenser and above the bottom wall of the dispenser with the transverse cutting edge formed at the forwardmost end of the bottom wall so that an operator pulls downwardly at the free end of the dispensable roll of paper across the transverse cutting edge to sever the free end of the dispensable roll of paper from the remainder of the roll of paper without subjecting the fingers and hand of an operator to the cutting edge.

DESCRIPTION OF THE DRAWINGS

FIG. 4 is a transverse sectional view of the dispenser shown in FIGS. 1-3 taken along line 4—4 of FIG. 3 to illustrate a gate for retaining the succeeding roll of paper in spaced relation to the dispensable roll of paper.

FIG. 5 is a perspective view of the gate employed in the dispenser shown in FIGS. 1-3.

FIG. 6 is an end view of the gate shown in FIG. 5.

FIG. 7 is a front elevational view of the gate shown in FIGS. 5 and 6.

FIG. 8 is a rear elevational view of the gate shown in FIGS. 5-7.

FIG. 9 is a fragmentary vertical sectional view of the dispenser shown in FIGS. 1-3 taken along line 9—9 of FIG. 1.

DESCRIPTION OF THE PREFERRED EMBODIMENT

Figure 3:
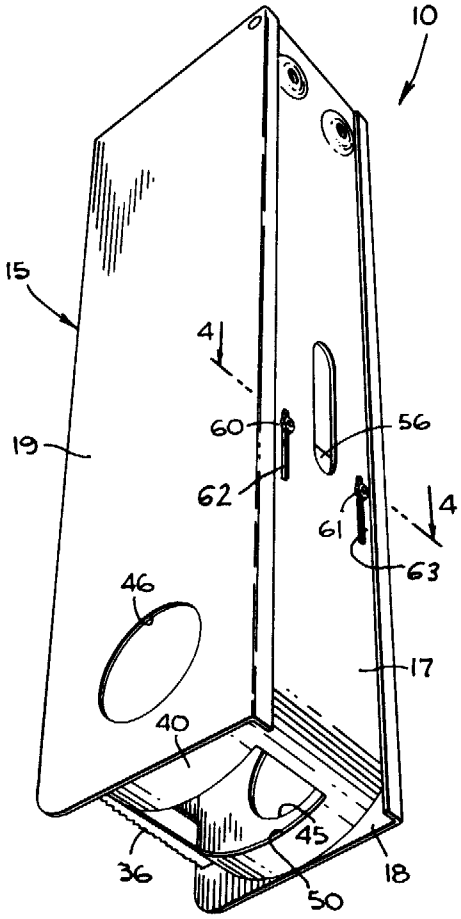
FIG. 3 is a perspective view of the dispenser shown in FIGS. 1 and 2 to illustrate the exit for the free end of the dispensable roll of paper and a cutting edge for the severance of the free end from the remainder of the dispensable roll of paper.
Figure 2:
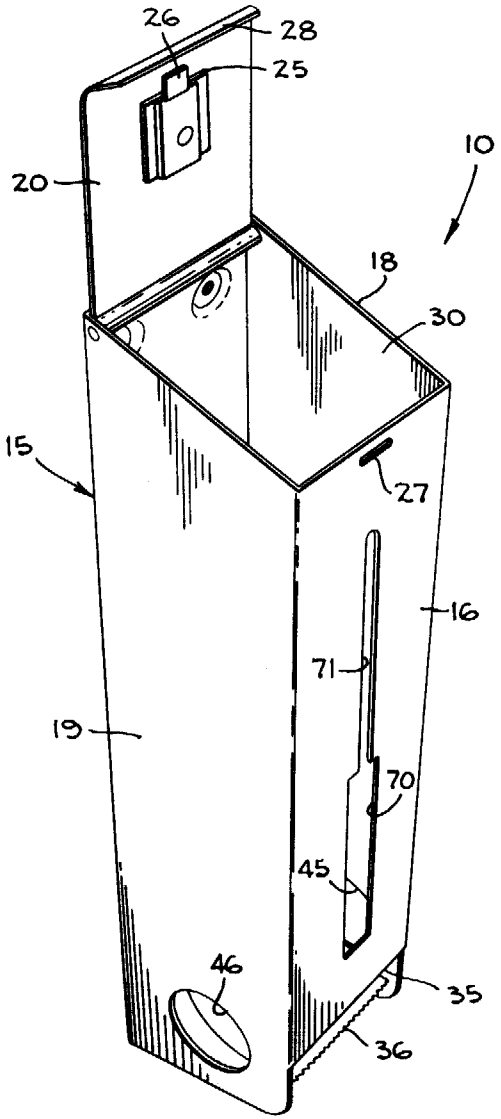
FIG. 2 is a perspective view of the dispenser shown in FIG. 1 with the cover thereof in an opened position for receiving rolls of paper.
Figure 1:
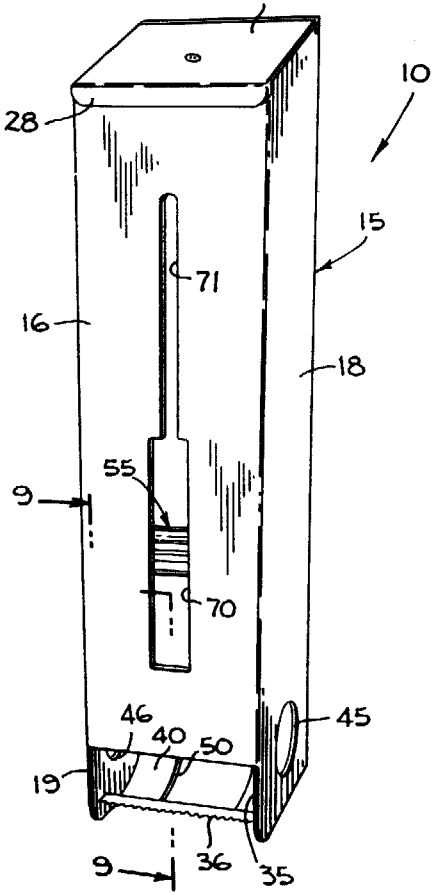
FIG. 1 is a perspective view of the dispenser embodying the present invention.

Illustrated in FIGS. 1-3 is a dispenser 10 embodying the present invention which comprises, in the preferred embodiment, a hollow, substantially rectanguloid housing 15 having a front wall 16, a rear wall 17 and side walls 18 and 19. The housing 15 is disposed in the upright position with its longitudinal center line extending in the vertical direction and having rectangular transverse cross-sectional areas. At the top of the housing is a hinged cover 20. The cover 20 includes a locking device 25 (FIG. 2) fixed to the lower wall. The locking device 25 comprises a stop 26 that enters a slot 27 in the front wall 16 to lock the cover 20 to the housing 15 and is retracted from the slot 27 to unlock the cover 20. When the cover 20 is closed, the flange 28 conceals the slot 27. An opening in the cover 20 receives a hexagonal spanner for moving the stop 26 between the locking and unlocking position.

When the cover 20 is in the opened position, a plurality of rolls of paper or the like is disposed in the housing 15 through the opening 30 with the axes thereof disposed transversely of the housing 15 between the side walls 18 and 19 in parallel relation to form a column of rolls of paper. In the exemplary embodiment, there are four rolls of paper vertically aligned with the axes thereof disposed horizontally in longitudinally spaced relation. In the exemplary embodiment, the rolls of paper are rolls of toilet tissue. However, rolls of paper towels or rolls of any other expendable material which can be torn at the free end thereof or can be severed by a knife edge may be employed with the dispenser 10 of the present invention.

At the lower section of the housing 15 is formed a paper exit opening 35 which extends between the side walls 18 and 19 and is of sufficient height to expose a lower portion of the dispensable roll of paper. The exit opening is defined by the front wall 16 and the side walls 18 and 19. Extending transversely across the paper exit opening 35 at the lower end thereof is a cutting edge 36 in the form of a serrated cutting edge. The cutting edge 35 is below the exit opening 35. Integrally formed with the cutting edge 36 is a curved bottom wall 40 suitable for seating a roll of paper thereon and suitable for supporting a roll of paper rotating thereon. The contour of the surface of the wall 40 on which the dispensable roll of paper seats conforms substantially to the configuration of the cylindrical wall of the dispensable roll of paper. The horizontal axis of the roll of paper seating on the bottom wall 40 is aligned with confronting openings 45 and 46 formed in the side walls 18 and 19.

The dispensable roll of paper is seated on the bottom wall 40 to be rotatable thereon. The free end of the dispensable roll of paper projects through the paper exit opening 35. An operator pulls downwardly on the free end of the dispensable roll of paper across the cutting edge 35 to sever the free end of the dispensable roll of paper from the remainder of the roll of paper. The remaining rolls of paper are disposed above the dispensable roll of paper with the axes thereof in a vertical plane. The axes of the rolls of paper are transversely disposed to extend in the horizontal direction at right angles to the side walls 18 and 19. Formed in the bottom wall 40 is an opening 50, which is sufficiently broad to permit initial turning of the dispensable roll of paper by means of the fingers of an operator to project the free end of the dispensable roll of paper out of the exit opening 35 to be gripped by an operator.

Should the dispensable roll of paper be formed with a relatively rigid core, such as a cardboard core, the core thereof is removed through the openings 45 and 46 in the side walls 18 and 19, respectively, after the supply of paper of the dispensable roll of paper has been expended. The openings 45 and 46 are of sufficient diameter to permit the core to be moved transversely by an operator in the axial direction for removal through either the opening 45 or the opening 46. The openings 45 and 46 are separate and apart from the paper exit opening 35.

For retaining the roll of paper succeeding the dispensable roll of paper in spaced relation thereto so as to prevent contact or engagement therebetween that would impede or interfere with the rotation of the dispensable roll of paper on the bottom wall 40, a gate 55 is provided (FIGS. 4-8). In the preferred embodiment, the gate 55 comprises a transversely disposed support member 56 extending between the side walls 18 and 19. The support member 56 is adjustably secured to the rear wall 17 of the dispenser 15 through nuts and bolts 60 and 61. Formed in the rear wall 17 are vertically disposed slots 62 and 63, which receive the bolts 60 and 61, respectively. Through this arrangement, the gate 55 may be adjustably secured in the vertical direction to accommodate variations in the size of the diameter of the dispensable roll of paper. Thus, the height of the gate 55 can be raised to accommodate a greater diameter for the rolls of paper so that the succeeding roll of paper is maintained spaced from the dispensable roll of paper, thereby not to be in contact therewith. Additionally, the present invention enables a gate to be replaced with facility in the event it needs replacement.

Attached to the support member 56 through the nuts and bolts 60 and 61 is a U-shaped spring 65 in the form of a metal wire. The legs of the U-shaped spring 65 are secured in a recessed portion 66 of the rear of the member 56 through the nuts and bolts 60 and 61 at the reversely directed distal ends thereof. The U-shaped spring 65 provides a yieldable gate. For this purpose, the U-shaped spring is directed toward the front wall 16 and projects slightly downwardly from the rear wall 17 toward the front wall 16. The free end of the succeeding roll of paper is maintained spaced from the front wall 16 and the rear wall 17 through the gate 55 to inhibit it from contact with the dispensable roll of paper. In the exemplary embodiment, the angle of declination from the horizontal is in the vicinity of 14° (FIG. 6). In a modification of the present invention, an angular flexible plate is employed in lieu of a metal wire. The flexible plate is similar in size to the wire 65 and extends transversely between the side walls 18 and 19 and projects toward the front wall 16. A support plate is integrally formed therewith that is secured by the nuts and bolts 60 and 61 between the rear wall 17 and the support plate 56.

When the supply of paper of the dispensable roll has been expended, the succeeding roll of paper is urged downwardly manually to displace the spring 65 for advancing the succeeding roll of paper beyond the spring 65 and into the position of the dispensable roll of paper. The spring 65 returns to its initial position under its resilient action to retain the roll of paper next in succession in spaced relation with the roll of paper now occupying the position of the dispensable roll of paper. The free end of the roll of paper now occupying the position of the dispensable roll of paper projects through the exit opening 35 for use by an operator.

Formed in the front wall 16 at the lower section thereof is a vertical opening 70 which is of sufficient width to receive at least one finger of an operator. The movement of the succeeding roll of paper to the position of the dispensable roll of paper against the urgency of the spring 65 is accomplished manually by an operator inserting at least one finger in the vertical opening 70 to urge the succeeding roll of paper to move downwardly in the housing 15. The gate 55 by projecting toward the front wall 16 urges the succeeding roll of paper toward the front wall 16 to enable an operator to advance it into the position occupied by a dispensable roll of paper with facility. Above the vertical opening 70 is formed a vertical opening 71, which is narrower than the vertical opening 70 and extends to the upper section of the housing 15. The vertical opening 71 enables an operator to observe the supply of rolls of paper in the housing 15 and is sufficiently narrow to inhibit the insertion of a finger therein.

We claim:

1. A dispenser for a plurality of rolls of paper or the like comprising:

(a) a longitudinally extending hollow housing having a rear wall, a front wall and confronting side walls;

(b) means at an upper section of said housing for depositing in said housing a column of rolls of paper, said column of rolls of paper extending in the longitudinal direction of said housing with the axes of said rolls of paper extending in parallel relation between said side walls and transversely of said housing;

(c) said front wall and said side walls at a lower section of said housing forming a paper exit opening for said housing;

(d) said housing being formed with a wall at the lower section thereof on which a dispensable roll of paper is seated for rotation, said dispensable roll of paper being a lower roll of said column of rolls of paper, said dispensable roll of paper having the free end thereof projecting through said paper exit opening;

(e) a cutting edge extending transversely across said paper exit opening for severing the free end of the dispensable roll of paper from the remainder of the roll of paper; and (f) a gate supported in said housing by said rear wall between said dispensable roll of paper and a succeeding roll of paper, said gate being arranged to retain said succeeding roll of paper out of contact with said dispensable roll of paper, said gate being displaceable in response to said succeeding roll of paper being moved into the position occupied by said dispensable roll of paper after the supply of paper of said dispensable roll of paper has been expended, said gate being returned to its initial position to retain the next succeeding roll of paper out of contact with the roll of paper now occupying the position of a dispensable roll of paper, said gate being adjustably supported in said housing by said rear wall in the longitudinal direction for accommodating rolls of paper of various diameters in maintaining the succeeding roll of paper out of contact with the dispensable roll of paper.

2. A dispenser as claimed in claim 1 wherein said gate comprises:

(a) a support plate adjustably mounted on said rear wall of said housing, and (b) a yieldable member supported by said support plate and projecting toward said front wall of said housing and projecting transversely relative to said housing between said side walls, the succeeding roll of paper rests on said yieldable member, said yieldable member being yieldable in response to the movement of said succeeding roll of paper into the position occupied by said dispensable roll of paper and being returned under its resilient action to its initial position to retain the next succeeding roll of paper out of contact with the roll of paper now occupying the position of a dispensable roll of paper.

3. A dispenser as claimed in claim 1 wherein said housing is formed with an opening at a point higher than the axis of the roll of paper retained by said gate through which an operator advances manually the succeeding roll of paper beyond said gate.

4. In a dispenser of the type wherein an upright housing is adapted to receive a vertical column of rolls of paper or the like with the lowest roll being disposed adjacent an opening in a lower wall of the housing through which paper from the lowermost roll may be dispensed, the improvement which comprises a gate adapted to be mounted on the inner surface of one of the walls of the housing to project inwardly therefrom into the path of downward movement of the rolls of paper in the housing, and means for mounting said gate in said housing at various positions vertically in the housing between the roll at the dispensing opening and the roll next above whereby the position of the gate may be adjusted for rolls of different diameters to assure that the roll next above the roll at the dispensing opening will not contact that roll.

5. A dispenser according to claim 4 wherein the means for mounting said gate in said housing includes at least one elongated longitudinally extending slot in one wall of said housing, and releasable fastening means connected to said gate and extending through the slot.

* * * * *